United States Patent [19]

Mistyurik

[11] 4,433,624

[45] Feb. 28, 1984

[54] PRINTING APPARATUS

[75] Inventor: John D. Mistyurik, Tipp City, Ohio

[73] Assignee: Monarch Marking Systems, Inc., Dayton, Ohio

[21] Appl. No.: 349,497

[22] Filed: Feb. 17, 1982

[51] Int. Cl.[3] ..... B41F 1/08

[52] U.S. Cl. ..... 101/314; 101/348

[58] Field of Search ..... 101/314, 348, 324, 359, 101/101, 103, 350

[56] References Cited

U.S. PATENT DOCUMENTS

| | | | |
|---|---|---|---|
| 1,215,900 | 2/1917 | Black et al. | 101/331 |
| 3,326,124 | 6/1967 | Heil et al. | 101/348 X |
| 3,859,915 | 1/1975 | Hunter | 101/103 |
| 4,044,677 | 8/1977 | Hamisch | 101/314 X |
| 4,051,781 | 10/1977 | Nishihawa | 101/348 |
| 4,273,046 | 6/1981 | Sato | 101/314 X |
| 4,313,377 | 2/1982 | Sato | 101/324 X |

*Primary Examiner*—Edward M. Coven

*Attorney, Agent, or Firm*—Joseph J. Grass

[57] ABSTRACT

There is disclosed printing apparatus composed essentially of molded plastics material which has relatively few parts, is easy to manufacture and maintain, and is lightweight and portable. The apparatus is illustrated as being of the table top type which can print both standard type tags and labels, string tags and pin tickets. The apparatus has a print head operable in conjunction with an impression control device, a feed finger assembly with a registration adjustment, a simple drive arrangement operated by a cam with a single cam path, and a reel positionable at different attitudes, and the construction of the apparatus is readily adaptable to both manually operated and motorized versions.

5 Claims, 37 Drawing Figures

FIG-18
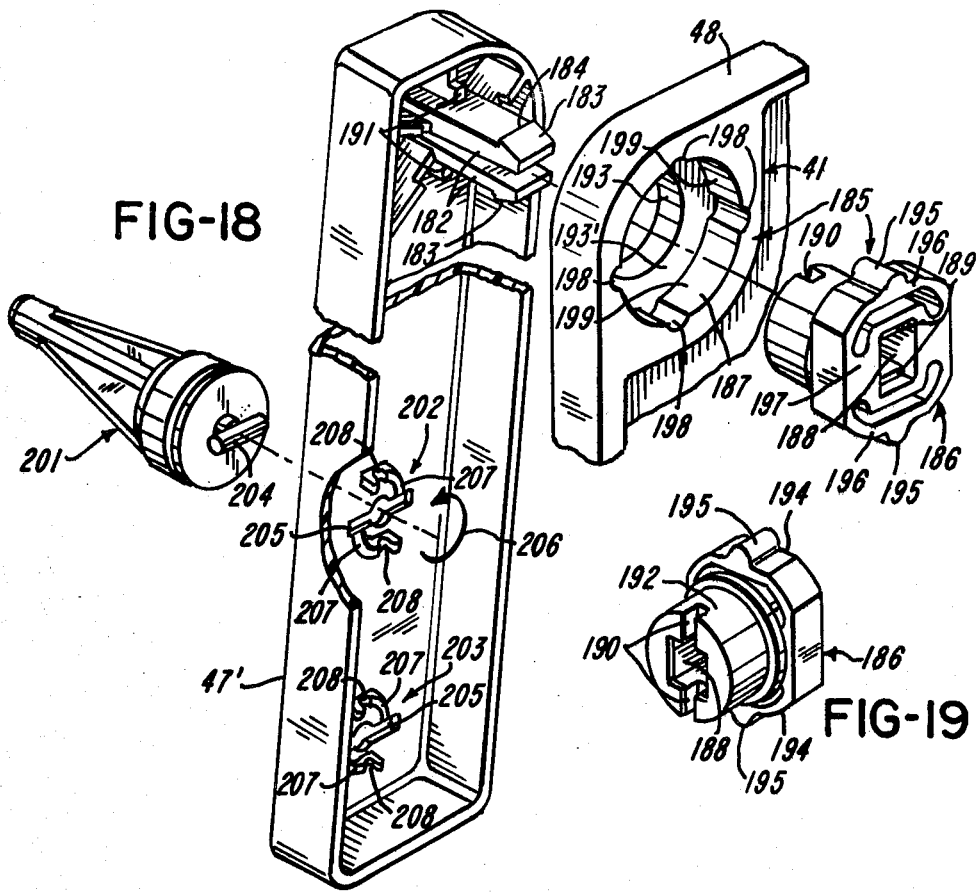
FIG-19
FIG-20
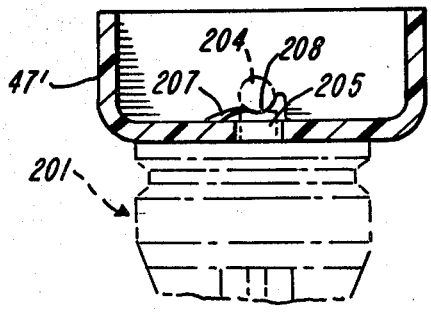
FIG-21
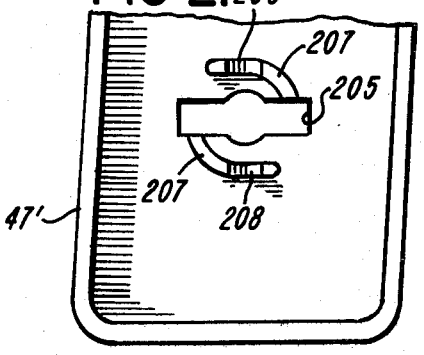

215'
213
214
215
210
216
235
235'
261'
234
211
217'
229
239
240
217
228
238
230
219
246
220
221
222
223
227
241
224
225
226
236
236'
218
233

220
244
245'
242
245
246
250
248
249
247
243
221
222

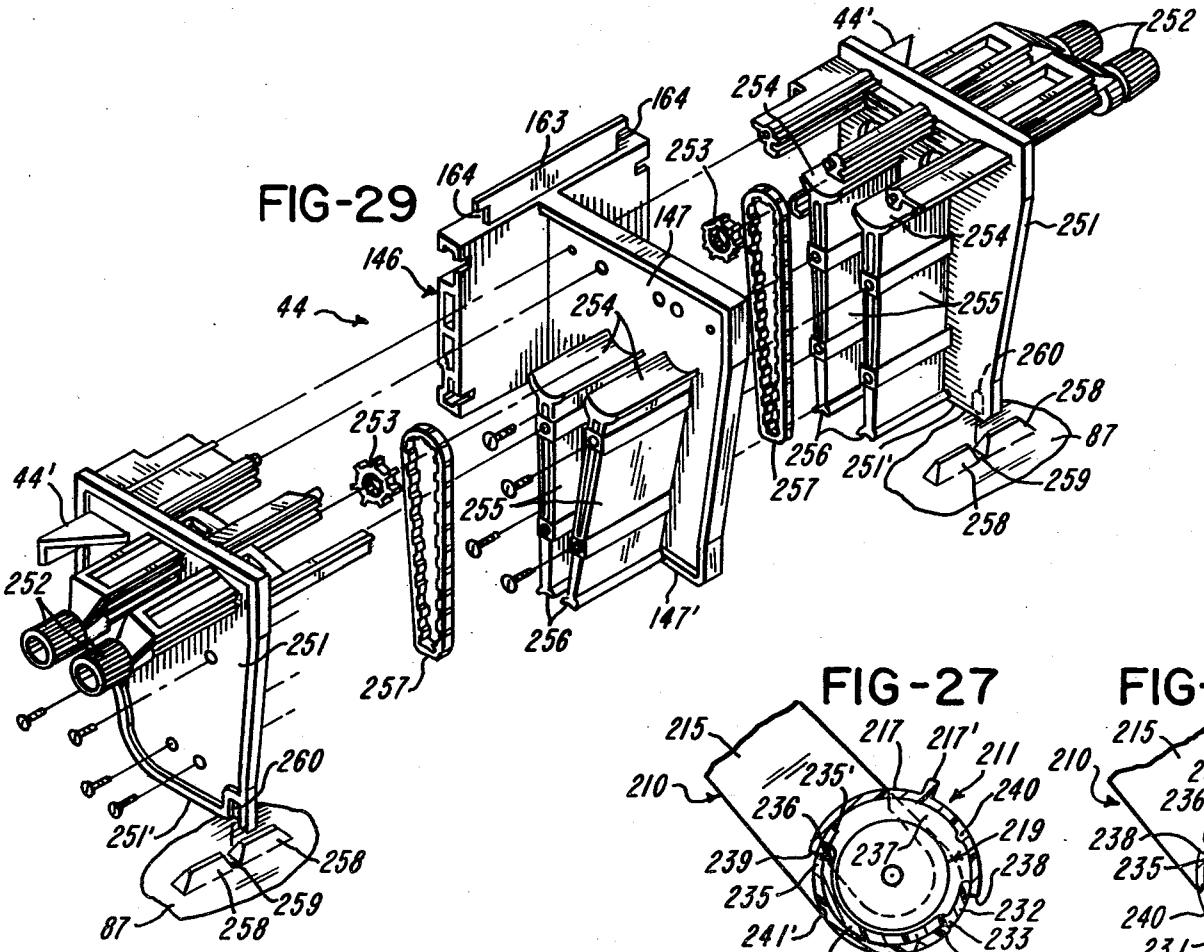
FIG-29
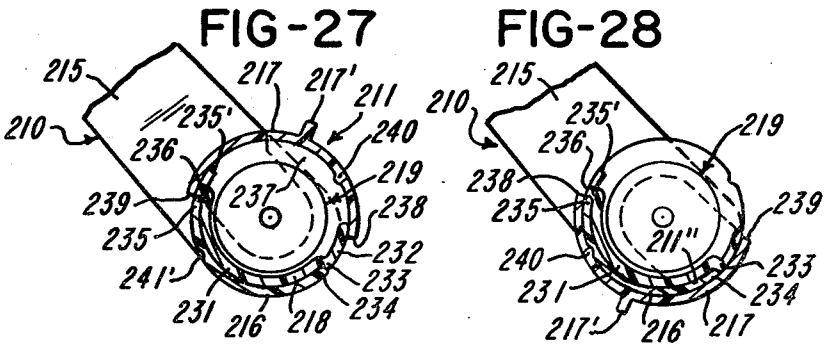
FIG-27
FIG-28

PRINTING APPARATUS

BACKGROUND OF THE INVENTION

1. Field of the Invention

This invention relates to printing apparatus and to method of coupling an ink cartridge to a carrier of an inker.

2. Brief Description of the Prior Art

Prior art U.S. Pat. No. 1,215,900 granted Feb. 13, 1917 to Black et al and U.S. Pat. No. 4,051,781 granted Oct. 4, 1977 to Nishikawa relate to ink rollers associated with covers. U.S. Pat. No. 491,046 granted Jan. 31, 1893 relates to an ink roller. U.S. Pat. No. 1,715,290 granted May 28, 1929 to Henry, Jr. relates to an adjustment for a feed finger. U.S. Pat. No. 2,271,840 granted Feb. 3, 1942 to Kohnle relates to a printing apparatus. U.S. Pat. No. 2,265,584 granted Dec. 9, 1941 to Stiegler, U.S. Pat. No. 4,280,862 granted July 28, 1981 to Hamisch, Jr. and U.S. Pat. No. 4,290,840 granted Sept. 22, 1981 Pabodie disclose impression control devices.

SUMMARY OF THE INVENTION

The invention relates to printing apparatus and method of coupling an anti-smudging ink cartridge to a carrier of an inker. The printing apparatus includes a novel arrangement for moving the print head in conjunction with an impression control device, and a novel feed finger assembly and method of making same.

BRIEF DESCRIPTION OF THE DRAWINGS

FIG. 18 is a broken-away exploded perspective view of the supply roll mounting structure;

FIG. 19 is a perspective view of a one-piece molded plastics detent also shown in FIG. 18;

FIG. 20 is a sectional view taken along line 20—20 of FIG. 17;

FIG. 21 is a sectional view taken along line 21—21 of FIG. 17;

FIG. 27 is a fragmentary sectional view showing an ink cartridge which includes the fountain roller, with the cover of the ink cartridge shown in the closed position;

FIG. 28 is a view similar to FIG. 27, but showing the cover in the open position;

FIG. 29 is a partly exploded perspective view of the print head;

FIG. 30 is a fragmentary view of one side plate and a disc of the reel shown in FIGS. 1 and 2;

DETAILED DESCRIPTION OF THE PREFERRED EMBODIMENTS

Figure 1:
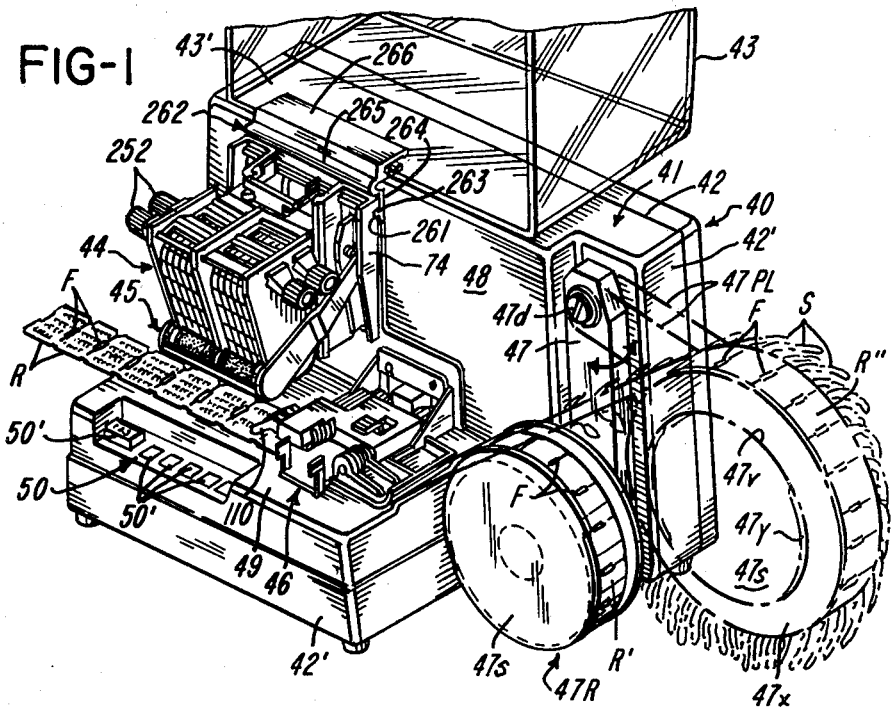
FIG. 1 is a partly broken-away perspective view of a table-top marking machine according to the invention.
Figures 2, 3C:
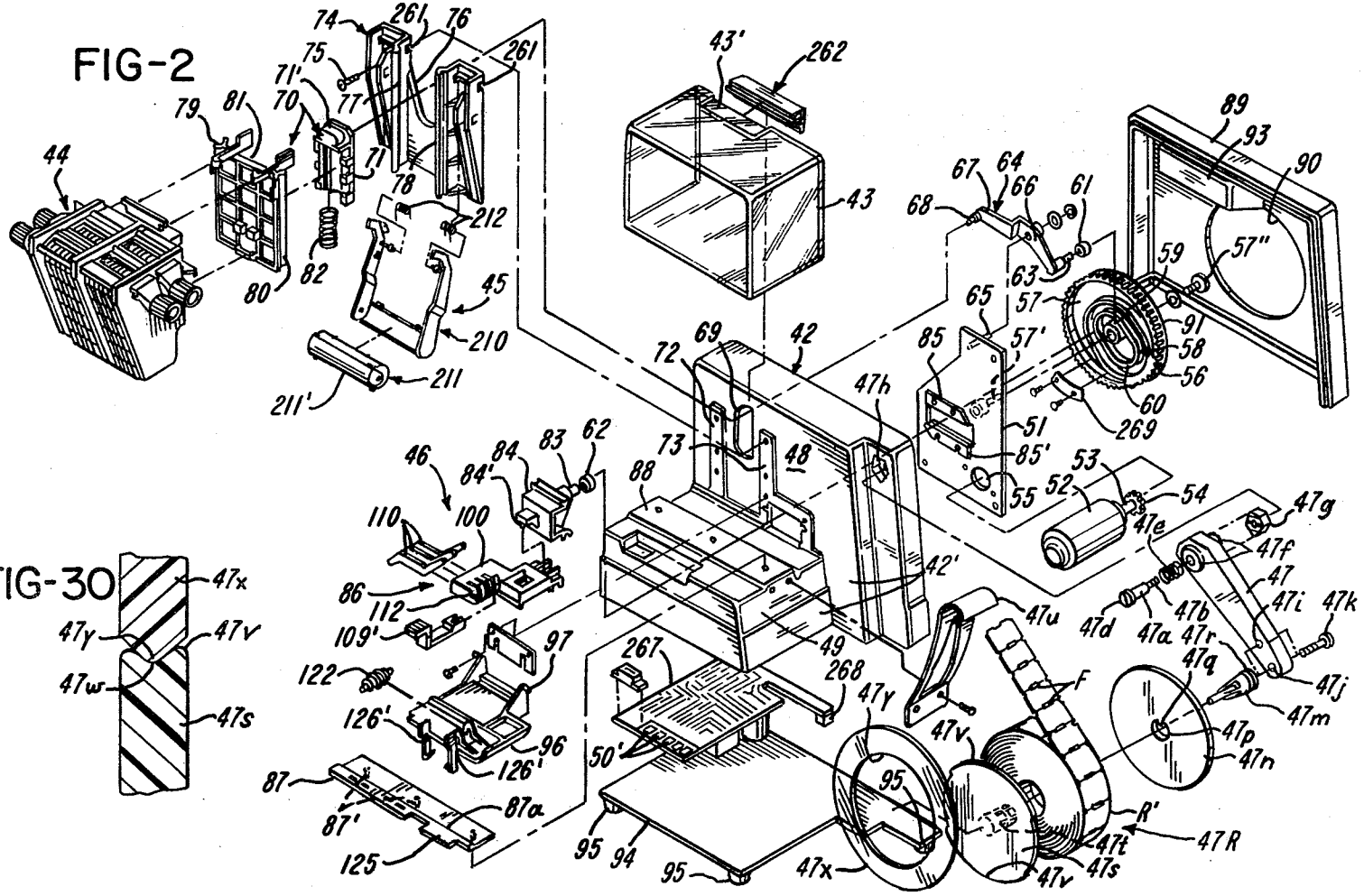
FIG. 2 is a partly exploded perspective view of the machine shown in FIG. 1.

With reference initially to FIG. 1, there is shown a printing apparatus generally indicated at 40 for printing on a web of record members R from the supply roll R′ or R″. The apparatus 40 includes a housing or frame generally indicated at 41 having a generally L-shaped frame member 42 or front panel with a rearwardly extending flange 42′. A cover 43 is shown in FIG. 1 to be in its open position in which a print head 44, an inking mechanism 45, and a feeding mechanism 46 are uncovered. The roll R' is shown to be mounted on a support member or support arm 47 which is movable from the solid line position shown to a phantom line position indicated by lines 47 PL. The solid line position is best adapted for standard type tags or labels, whereas the phantom line position for the arm 47 is best adapted for string tags of which roll R" is comprised. The frame member 42 has an upstanding or vertical portion 48 and a horizontal portion 49. A control panel 50 is disposed at the front of the apparatus 40 and is accessible even when the cover 43 is in the closed position. With reference to FIG. 2, there is shown an upstanding metal frame plate 51 which is secured by fasteners to the rear side of upstanding portion 48. An electric motor 52 has an output shaft 53 to which a pinion 54 is secured. The electric motor 52 is suitably secured to the plate 51. The shaft 53 passes through hole 55 in the plate 51 and the pinion 54 meshes with a gear 56 having teeth 56' shown to be formed at the outer periphery of a cam 57. The cam 57 is of one-piece molded plastics construction and the gear 56 is molded integrally therewith. The cam 57 has a single cam path 58. Although the cam path 58 is shown to be defined by a pair of spaced walls or surfaces 59 and 60 between which follower rollers 61 and 62 are captive, a cam path 58 can also be provided by a single wall or surface in which event a spring would be required to keep the respective roller 61 or 62 in contact therewith during rotation of the cam 57. Accordingly, while the walls 59 and 60 do provide a cam track, the term "track" is not considered to be limited to the preferred dual wall cam arrangement illustrated. The roller 61 is received on a stud 63 of a bellcrank generally indicated at 64. The bellcrank 64 which is a follower is pivotally mounted on a pivot 65 secured to the plate 51. The bellcrank 64 has arms 66 and 67. The stud 63 is carried by the arm 66 and the arm 67 carries a drive member or drive pin 68. The drive member 68 extends through a slot 69 in the upstanding portion 48 and drives a coupling device generally indicated at 70. The drive member 68 is received in a recess or socket 71' in a coupling member 71 of the device 70. The upstanding portion 48 has a pair of spaced lands 72 and 73 to which a support generally indicated at 74 is secured by suitable fasteners 75. The support 74 includes a U-shaped cutout or slot 76 generally aligned with the slot 69 to allow movement of the drive member 68. The support 74 is shown to have a pair of opposed track members or guides 77 and 78 for receiving mating track members 79 and 80 of a coupling member 81. The coupling members 71 and 81 are coupled to each other and are capable of relative movement against the urging of a spring 82 as will be described in greater detail below. The coupling member 81 is releasably coupled to the print head 44. The coupling device 70 also includes the coupling member 81 and the spring 82.

One complete revolution of the cam 57 moves the print head 44 once into and out of printing cooperation with the platen and moves the feed finger assembly 86 once in the forward direction toward the print head 44 and once away from the print head 44. Printing preceeds feeding.

Figure 12:
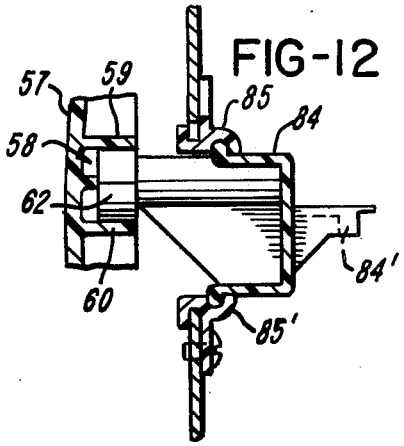
FIG. 12 is a sectional view taken along line 12—12 of FIG. 11.

The roller 62 is received on a drive member or pin 83 of a slide or holder 84. The slide 84 is slidably mounted between a pair of track members 85 and 85' mounted to the frame plate 51 as best shown in FIG. 12. The slide 84 has a pin 84' which drives a feed finger assembly generally indicated at 86. A platen generally indicated at 87 is suitably secured to a land 88 of the horizontal portion 49. The upper surface of the platen 87 is perpendicular to the straight path of the print head 44, the path of the print head 44 being determined by the straight track members 77 and 78 and the cooperable straight track members 79 and 80. The frame 41 also includes a rear cover or panel 89 which mates with the upstanding portion 48. The cover 89 has an annular hole 90 only slightly larger than the gear 56. The teeth 56' of the gear 56 terminate short of rear face 91 of the gear 56 so that the teeth 56' are not exposed, so as to prevent injury. The cover 89 has an integrally formed recess 92 (FIG. 31) provided by an inwardly extending wall 93 (FIG. 2). The recess 92 is accessible to the user's fingers and serves as a handle by which the apparatus 40 or 40' can be carried. Underlying the upstanding and horizontal portions 48 and 49 is a bottom panel or cover 94 which serves to close off the inside of the apparatus 40. The panel 94 can be constructed of sheet metal or plastic and has four spaced mounting pads 95. The lower portions of the upstanding portion 48 and the horizontal section 49 constitute a base 42'.

Figures 4, 31:
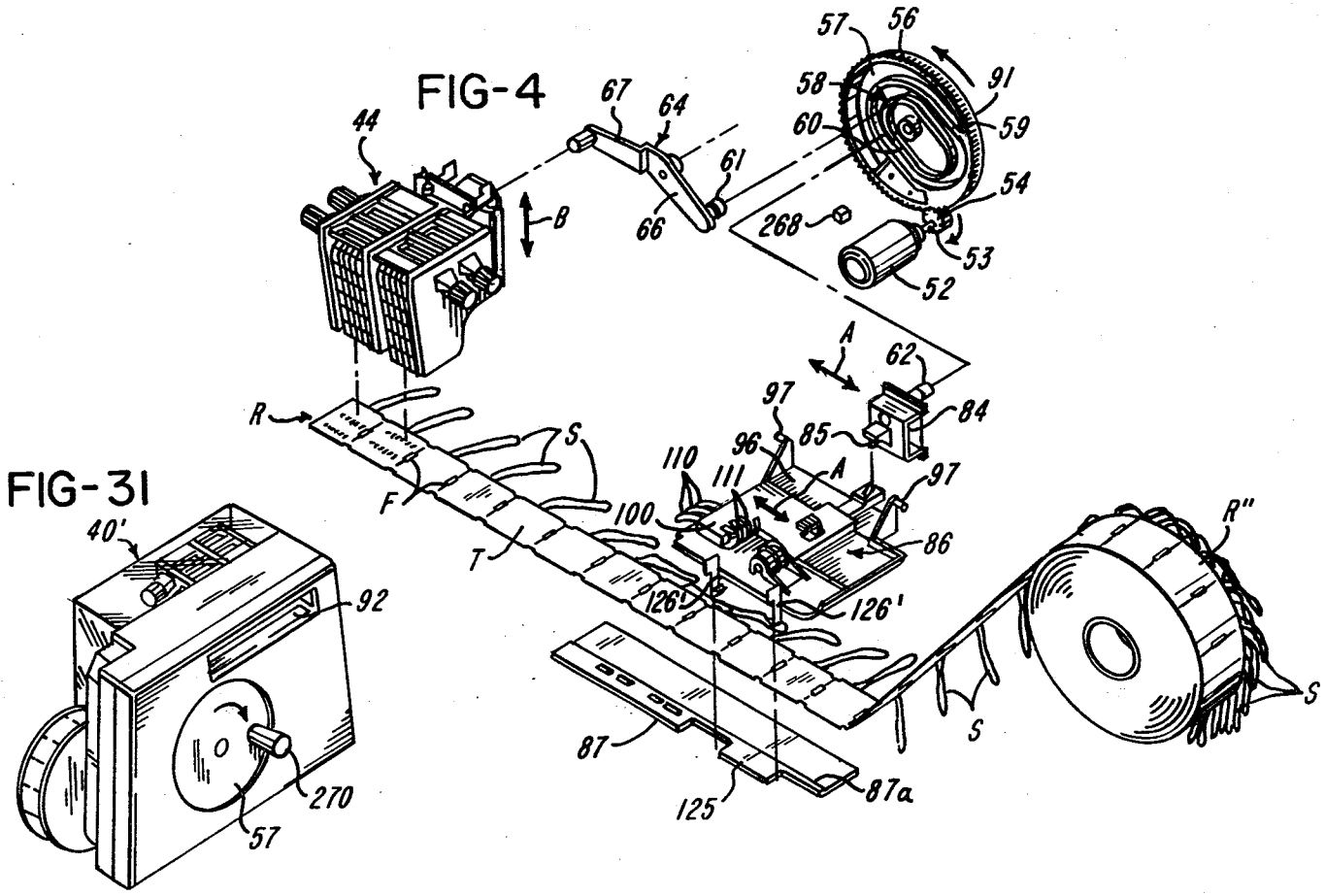
FIG. 4 is a fragmentary partly exploded perspective view showing the drive for the print head and the feeding mechanism.
FIG. 31 is a perspective view of a hand-operated version of the marking machine of the embodiments of FIGS. 1 through 30.

With reference to FIG. 4, the feed finger assembly 86 is shown to be slidably mounted on a support 96. The support 96 has a pair of pivot pins 97 by which the support 96 is pivotally mounted by recesses 97' in upstanding portion 48. The support 96 is normally in the position shown in FIGS. 7 and 8 for example in overlying parallel relationship with respect to the platen 87, but it is pivotal about pivots or pins 97 to a raised position to expose the portion of the platen 87 which it normally overlies. The platen 87 is illustrated as being longer than the width of the print head 44 and provides a guide surface for the web of record members R.

Figure 7:
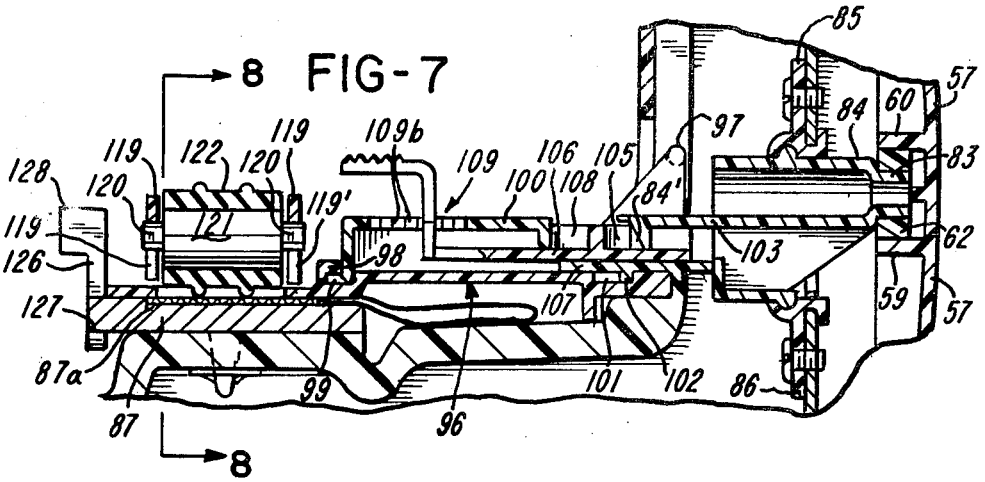
FIG. 7 is a sectional view taken along line 7—7 of FIG. 6.
Figure 8:
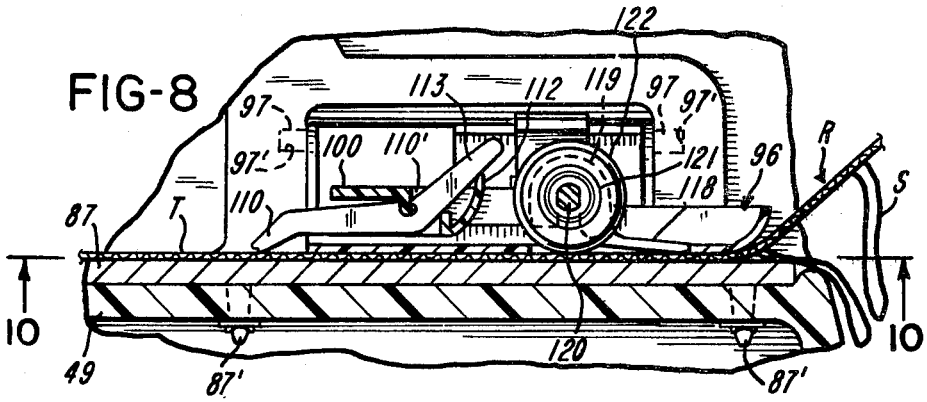
FIG. 8 is a sectional view taken along line 8—8 of FIG. 7.

With reference to FIGS. 7 and 8, the support 96 is shown to have a groove 98 for receiving a flange or tang 99 of a holder or slide 100. The feed finger assembly 86 is part of the slide 100. The support 96 also has a groove 101 for receiving a projection 102 at the underside of the slide 100. The slide 100 is thus guided for reciprocal straight line movement in the directions of double-headed arrow A (FIG. 4) perpendicular to the path of straight line movement of the print head 44 as indicated by double-headed arrow B.

Figure 9:
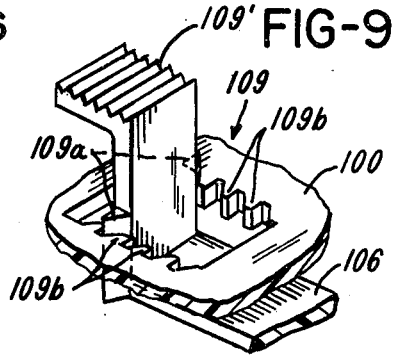
FIG. 9 is a fragmentary perspective view showing the detent for the feeding mechanism.
Figure 6:
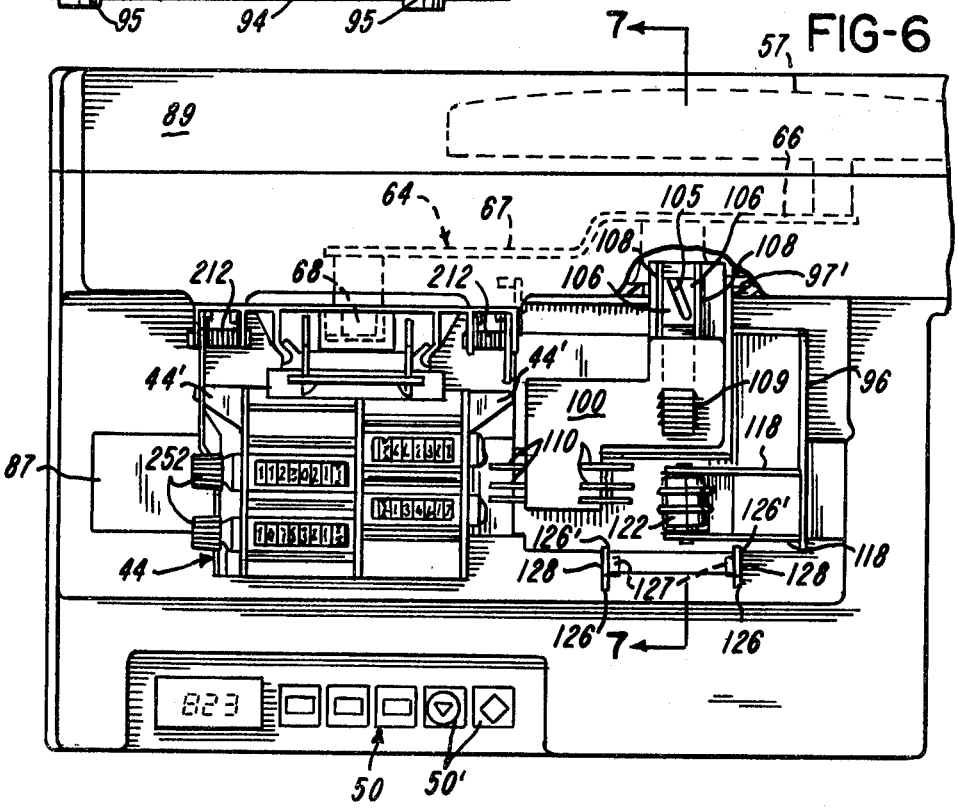
FIG. 6 is a top plan view of the machine.

The slide 84 has a drive member 103 which terminates at depending annular member or pin 94'. The pin 84' is received in a slot 105 inclined at an angle other than perpendicular with respect to the path of movement of the slide 84. The slot 105 is provided in an adjusting member 106. The adjusting member 106 slides on a flange 107 of holder 100. The adjusting member 106 is guided for movement perpendicular to the direction of travel of the slide 84 between a pair of parallel spaced walls 108 in the slide 84 (FIG. 6). The adjusting member 106 includes a detent generally indicated at 109 shown in greater detail in FIG. 9. The detent 109 holds the adjusting member 106 in any adjusted position. However, by depressing button 109', the adjusting member 106 which is flexible and resilient will deflect and teeth 111 will move out of the gap between adjacent pairs of teeth 112 so that the adjusting member 106 can be shifted laterally. Shifting the adjusted member 106 laterally will change the initial and final positions of travel of feed fingers 110, thereby changing the start and stop positions of the record members R. The adjusting device 106 can thus be used to adjust the registry of the record members R with respect to the print head 44. Once the adjusting member 106 has been adjusted, finger pressure on the button 109' can be released and the teeth 111 will ascend into the spaces between corresponding pairs of teeth 112. The detent device 109 will thus hold the adjusting member 106 in the correct position relative to the pin 104.

Figure 22:
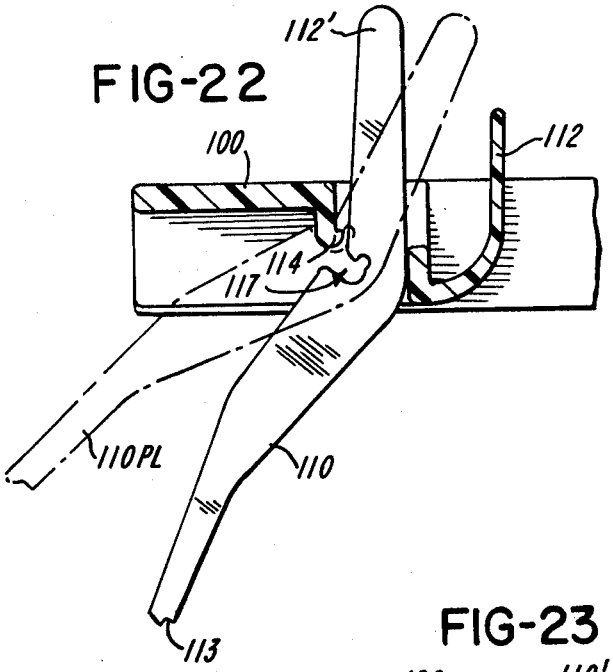
FIG. 22 is a sectional elevational view showing a feed finger in solid lines in preparation for assembly onto its holder and in phantom lines partially assembled onto the holder.
Figure 23:
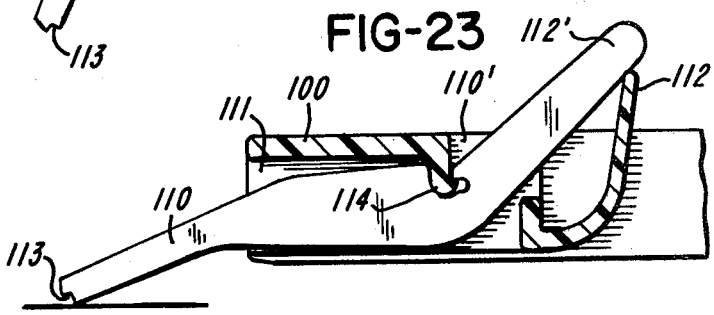
FIG. 23 is a view similar to FIG. 22 but showing the feed finger in its feeding position.
Figure 24:
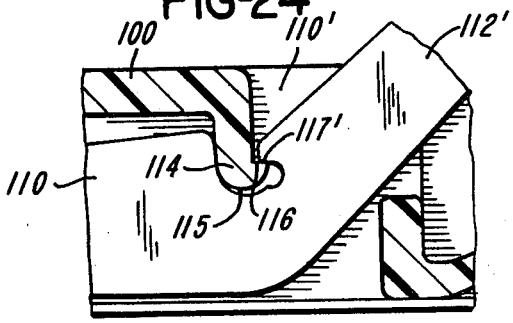
FIG. 24 is an enlarged fragmentary elevational view best showing the construction by which the feed finger is pivotally coupled to the holder.

The holder 100 pivotally mounts the feed fingers 110 as will be described in greater detail hereinafter. While it is preferred that three feed fingers 110 be used to accommodate webs of record members R of different widths having different arrangements of feed holes F, any desired number can be used. The holder 100 has slots 110' in which the feed fingers are guided for pivotal movement. The holder 100 also includes an integrally molded separate leaf spring or spring finger 112 for each feed finger 110. The leading edge of each feed finger 110 is stepped as best indicated at 113 in FIG. 23 for example. Each spring finger 112 exerts a force on the arm 112' of the respective feed finger 110, thereby urging the feed finger 110 into contact with the web of record members R. Each feed finger 110 is assembled in the manner illustrated in FIGS. 22 through 24. With reference to these figures, the holder 100 is shown to have depending members 114 each having a generally rounded lower surface 115 and terminating at a shoulder 116. Each feed finger 110 has an undercut recess generally indicated at 117. Each feed finger 110 has a shoulder 117' which cooperates with the shoulder 116 to hold the feed finger 110 captive. The feed finger 110 is assembled onto the holder 100 by pushing the feed finger 110 in the attitude shown in solid lines in FIG. 22. When the feed finger 110 has been inserted to a position in which the shoulders 116 and 117' are face-to-face, the feed finger 110 is pivoted in the clockwise direction through the position shown by phantom lines 110 PL in FIG. 22 to the solid line position shown in FIG. 23. The feed finger 110 is now assembled onto the holder 110 and is hooked to the holder 100 even through there are no separate pieces used to accomplish this. It is noted that when the feed finger 110 has been moved to the position shown in FIG. 23, the spring finger 112 is flexed from the as-molded position shown in FIG. 22.

The support 96 includes a pair of laterally spaced spring fingers 118 molded integrally therewith. Each spring finger 118 has an inverted U-shaped portion 119 having a slot 119' for receiving respective non-circular shaft-portions 120. The shaft portions 120 constitute part of a one-way clutch 121 on which an elastomeric sleeve 122 composed of frictional material and having annular rings 123 is positioned. The one-way clutch 121 and the sleeve 122 prevent retrograde movement of the web of record members R which may be caused during the return stroke of the feed fingers 110. Accordingly, with reference to FIG. 8 the one-way clutch 121 allows the sleeve 122 to rotate closkwise as the feed fingers 110 advance the web of record members R from right to left but prevents the sleeve 122 from rotating clockwise and thus the sleeve 122 prevents the web of record members from moving from left to right.

The platen 87 has a lateral extension 125 cooperable with latch members 126 for latching the support 96 in the operating position shown in FIG. 7 for example. The latch members 126 have shoulders 127 which engage the underside of the platen extension 125. The latch members 126 are deflectable and the shoulders 127 are normally engaged with the underside of the platen extension 125. However, the latch members 126 have finger-engageable tabs or pads 128 (FIG. 6) engageable for instance by the thumb and index finger of the user's one hand. By applying a manual squeezing action to the tabs 128, the shoulders 127 swing clear of the extension 125 and the support 96 can be pivoted upwardly about pins 97 to allow access to the platen 87. Each latch 126 is joined to the support 96 by an integral flexible resilient hinge 126'. The feed fingers 110 can conveniently be assembled when the holder 100 is in its upwardly pivotal position.

Figure 10:
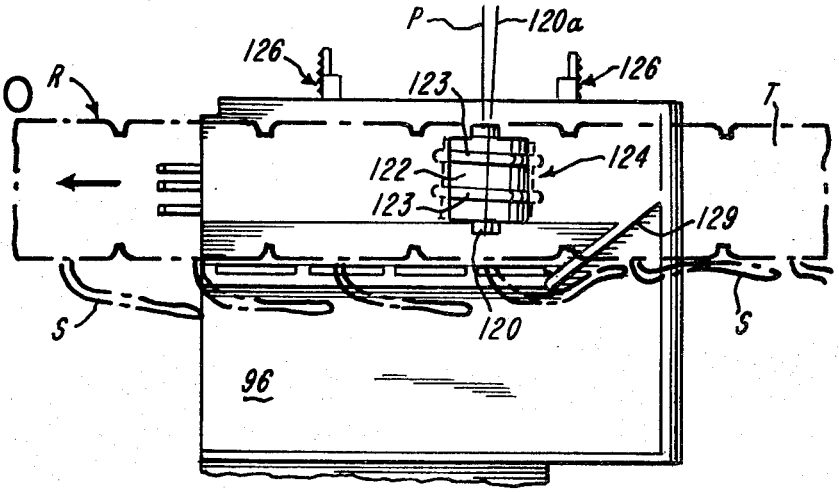
FIG. 10 is a view taken along line 10—10 of FIG. 8.
Figure 11:
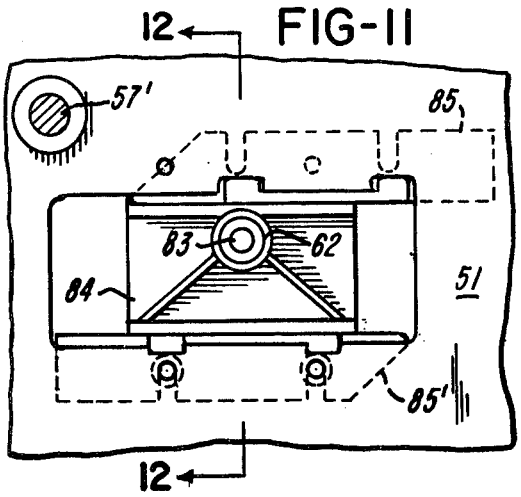
FIG. 11 is a fragmentary elevational view showing how the follower for the feeding mechanism is mounted.

The underside of the support 96 is provided with a cam 129 shown in FIG. 10. The purpose of the cam 129 is to cam the strings S of string tags T out from between the tags T and the platen 87. The cam 129 also serves to keep the strings S untangled. The cam 129 is molded integrally with the underside of the support 96.

Figure 5:
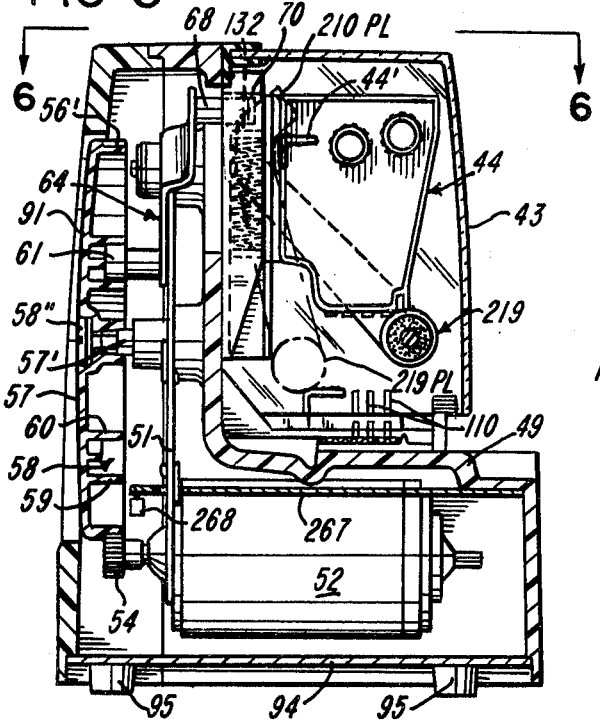
FIG. 5 is a vertical sectional view of the machine.
Figure 13:
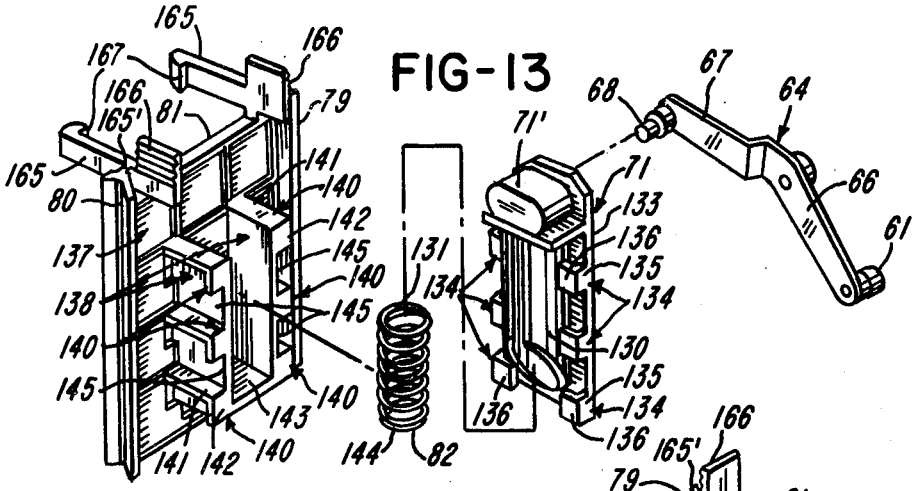
FIG. 13 is an exploded perspective view showing a portion of the drive mechanism for the print head, with parts rotated for clarity.

With reference to FIG. 13, the coupling member 71 is shown to have a vertically extending sleeve portion 130 for receiving the spring 82. The upper end 131 of the spring 82 bears against a shoulder 132 (FIG. 5). The shoulder 132 forms the lower portion of the socket 71'. The coupling member 71 has a vertically extending wall 133. Extending outwardly from the wall 133 are L-shaped members 134 each having a vertically extending leg 135 and another vertically extending leg 136. Coupling member 81 is shown to have a vertically extending wall 137 and a pair of spaced vertically extending sections 138. L-shaped members 140 are joined to the respective sections 138. Each L-shaped member 140 has a horizontal portion 141 and a vertical portion 142. The coupling member 81 also has a land or abutment face 143 against which other end 144 of the spring 82 abuts. The coupling members 71 and 81 can be assembled by first inserting the spring 82 into the sleeve 130, thereafter bringing the coupling members 71 and 81 into alignment so that the end 144 of the spring 82 abuts the land 143, moving the coupling members 71 and 81 relative to each other to compress the spring 82, pushing the connector members 134 into gaps 145 between vertically adjacent connector members 140, and allowing the spring 82 to urge the connector members 134 against portions 141. The coupling members 71 and 81 and the spring 82 are thus assembled and provide a spring module which can be easily handled even though the spring is partly loaded. Each portion 136 can slide in face-to-face relationship with its respective vertical portion 142 without the members 71 and 81 becoming uncoupled because the spring 82 only moves through a short distance. However, the coupling members 71 and 81 can be uncoupled by moving them through a substantially greater distance and withdrawing the connector members 134 out of the gaps 145. Such disassembly may be beneficial should maintenance be required. The spring 82 compresses slightly each time the print head 44 encounters resistance, specifically when it moves into cooperation with the platen 87 to cushion the printing.

Figure 14:
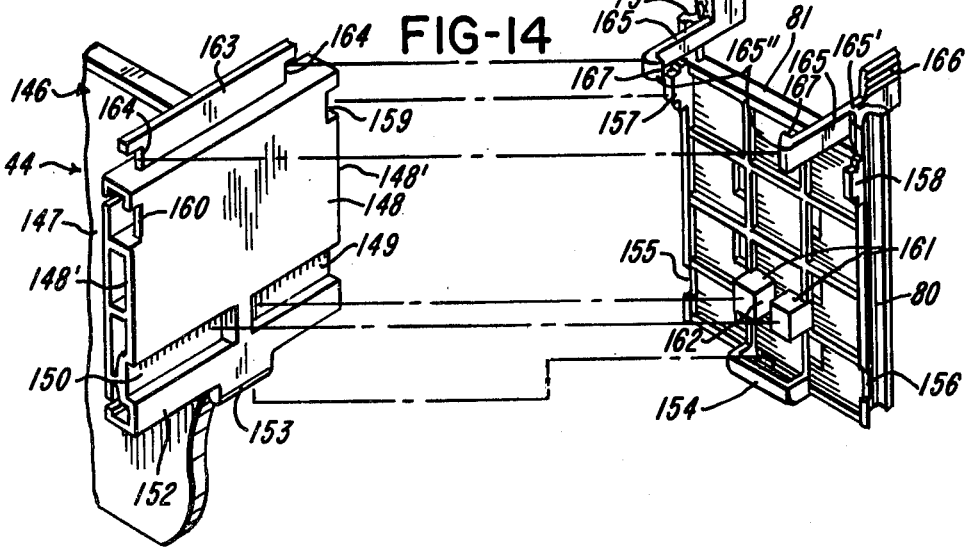
FIG. 14 is a fragmentary perspective view with parts rotated showing the manner in which the print head is releasably coupled to the drive mechanism for the print head.

With reference to FIG. 14, there is shown a fragmentary portion of a T-shaped frame or body generally indicated at 146 of the print head 44. The print head frame 146 has a pair of vertically extending walls or plate portions 147 and 148 joined at a right angle. The joinder of walls 147 and 148 is shown to be approximately midway between ends 148' of the wall 148. The walls 147 and 148 are integrally molded of moldable plastics material. The wall 148 which is a mounting portion has a pair of channels 149 and 150 spaced apart by a vertically extending flange or projection 151. The one side of each channel 149 is formed by a bar portion 152 having a depending projection 153 which extends into a socket or recess 154 of the coupling member 81. The track members 79 and 80 are notched as indicated at 155 and 156 and receive the bar portion 152. The track members 79 and 80 also have projections or locators 157 and 158 received in respective recesses 159 and 160 in the wall 148. The coupling member 81 also has a pair of spaced projections 161 which straddle the projection 151 and fit snugly into channels 149 and 150. The projections 161 define a recess 162 in which the projection 151 is received. The locators 151, 152, 157 and 158 and respective locator-receiving recesses 162, 155 and 156, and 159 and 160 as well as the projection 153 and the socket 154 serve to locate and partially couple the coupling member 81 and the wall 148 of the print head frame 146 to each other.

There is a connector 163 having a pair of spaced notches 164 for receiving latch members 165. The upper portion of the track members 79 and 80 are joined to latch members 165 by flexible and resilient integral hinges 165' so that when finger engageable tabs or pads 166 are squeezed between the user's thumb and index finger of one hand, the latch members 165 move clear of the connector 163. In the assembled position of the latches 165, shoulders 167 of latch members 165 extend through recesses 164 and engage the bar 163. Terminal ends of the latches 165 have cam faces 165" which cam the latches 165 outwardly during assembly to enable the latches 165 to snap into locked position.

Figure 15:
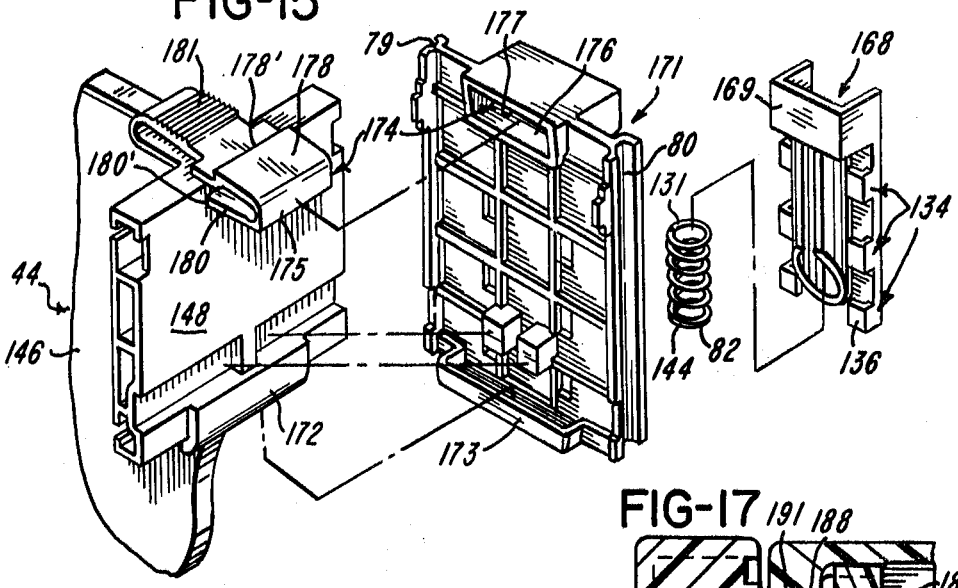
FIG. 15 is an exploded perspective view of an alternative embodiment from that shown in FIGS. 13 and 14 and shows a portion of the alternative drive mechanism and the print head, with the print head being rotated for clarity.
Figure 16:
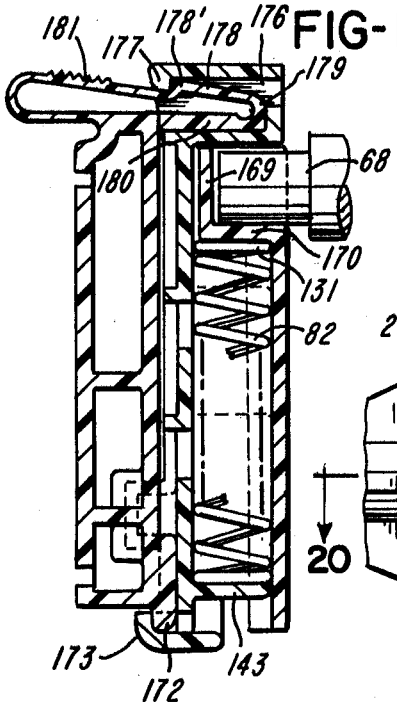
FIG. 16 is a sectional assembled view of the alternative embodiment shown in FIG. 15.

The embodiment of FIGS. 15 and 16 is the same as the previously described embodiment except as indicated hereinafter. Wherever possible the same reference characters are used to designate like components. Coupling member 168 is the same as coupling member 71 except that the upper portion is channel-shaped as indicated at 169. The upper end 131 of the spring 82 acts on lower face of a land 170. Coupling member 171 is the same as the coupling member 81 except that the projection 172 is longer than the projection 153 and the recess 173 is longer than the recess 154. In addition, the coupling member 171 is releasably latched to the print head frame 146 by a latch generally indicated at 174 which differs from the latch arrangement described above. The latch 174 includes a projection 175 received in a recess 176 having a shoulder 177. The projection 175 has a yieldable portion 178 joined at an integral hinge 179 to an end section 180. Terminal end 180' of end portion 180 is not attached to wall 148. The yieldable portion 178 has a tooth 178' cooperable with the tooth 177 as shown in FIG. 16 to hold the print head frame 164 to the coupling member 171. The print head 44 is removable from the coupling member 171 by pressing on a finger-engageable portion 181, thereby causing the yieldable portion 178 to deflect until the teeth 177 and 180 are disengaged, whereupon the print head 44 is released and can be removed from the coupling member 171. Latching of the print head 44 to the coupling member 171 is accomplished by inserting the projection 172 into the recess 176 and pivoting the print head 44 so that the projection 175 is inserted into the recess 176 until the tooth 178' snaps over tooth 177. Such insertion results in resilient deflection of the yieldable member 178 and when the tooth 178' clears the tooth 177 the yieldable member 178 moves to the position shown.

Figure 3:
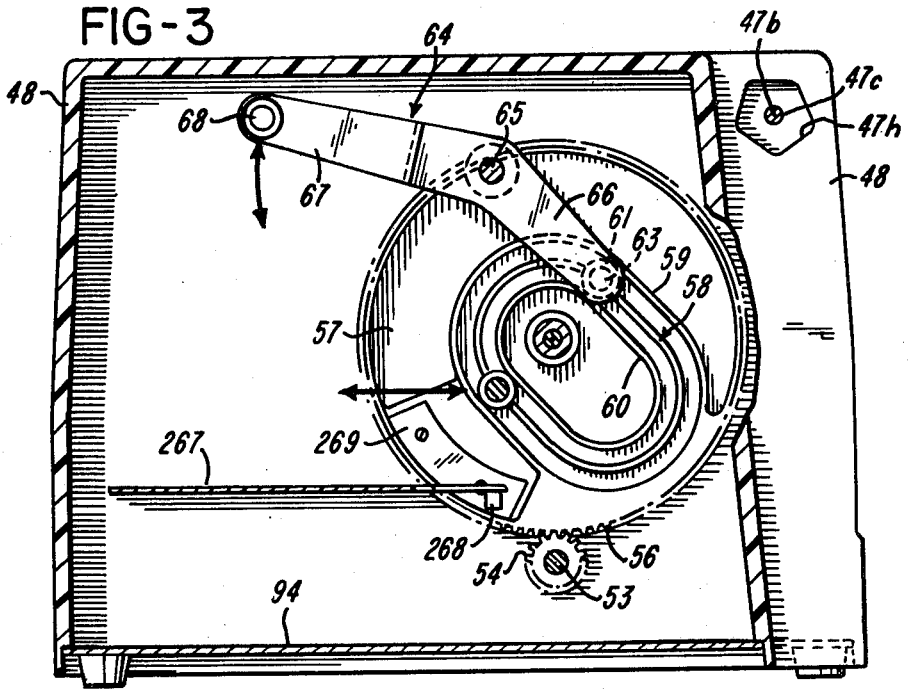
FIG. 3 is a vertical sectional view showing the relationship of a drive cam in relation to other structure.

With reference to FIGS. 1 through 3, the support member 47 is mounted to the vertical portion 48 by a pivot screw **47*a* having a threaded portion 47*b* received in a threaded bore 47*c* in vertical portion 48. The pivot screw 47*a* has a head 47*d*. A compression spring 47*e* is received about screw 47*a* between the head 47*d* and a boss 47*f* on the support member 47. The other side of the support member 47 has an integrally molded non-circular, specifically five-sided, projection 47*g* which is shown exploded away in FIG. 2. The projection 47*g* can be received in any one of a plurality, specifically two, of operating positions in a mating non-circular, specifically five-sided, recess 47*h* in vertical portion 48. The support member 47 has spaced holes 47*i* and 47*j*. A screw 47*k* can be selectively inserted through either hole 47*i* or 47*j* and removably threaded into a hub or hub member 47*m*. A disc 47*n* has a hole 47*p* which can be snapped onto hub 47*m* so that a small tang 47*q* fits into groove 47*r*. Another disc 47*s* is coupled to the hub 47*m* by a member 47*t*. The side portion 47*n* and 47*s* and hub 47*m* are considered to comprise a reel 47R. The roll R' of standard type tags or labels R is mounted on the support member 47 in the solid line position shown in FIG. 1 in which event the screw 47*k* extends through hole 47*i*. The roll R" of string tags T is preferably mounted on the support member 47 in the position shown by phantom lines 47PL in which event the screw 47*k* extends through either hole 47*i* or 47*j*. In both positions of the support member 47, the web passes over a flexible resilient member or leaf spring 47*u* (omitted in FIGS. 1 and 6). The flexing of the spring 47*u* is especially useful when string tags R" are used because the movement of the spring 47*u* imparts an undulating untangling movement to the strings as the web is intermittently advanced by the feed fingers 110**.

Figure 17:
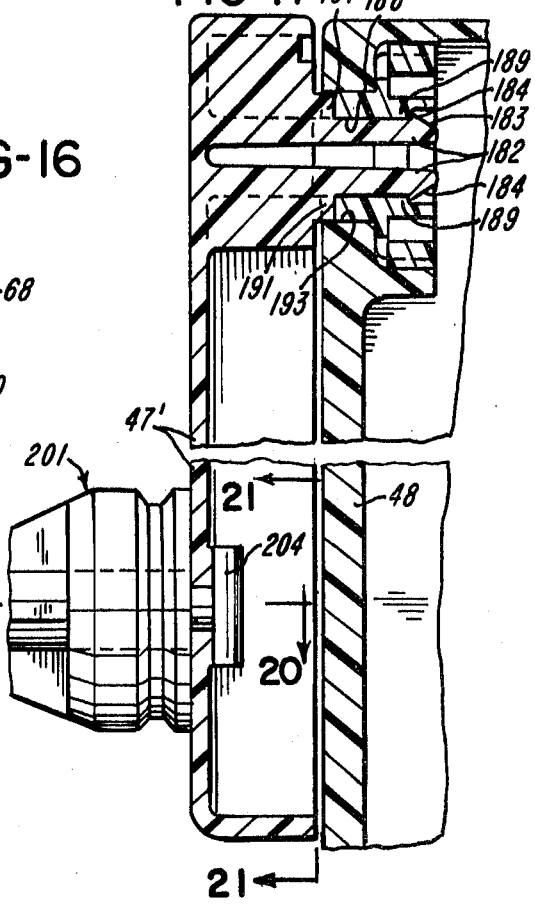
FIG. 17 is a broken-away sectional view of the supply roll mounting structure.

With reference to FIGS. 17, 18 and 19, there is shown an alternative arrangement by which a roll support member can be held in a selected position. Support member 47' is the same as the support member 47 except for the manner in which it is mounted to vertical portion 48 and the way the hub member is removably connected to the support member 47'. The support member 47' is shown to have a pair of integrally molded, outwardly sprung projections 182 having tapered end portions 183 terminating at shoulders or teeth 184. A detent or detent mechanism generally indicated at 185 includes a detent member 186 and an opening 187 formed in the upstanding portion 48 of the frame 41. The detent member 186 is shown to have a rectangular hole 188 which is stepped to provide a pair of teeth 189 snap-fitted and cooperable with the teeth 184 to hold the detent member 186 coupled to the projections 182. It is apparent that the detent member 186 rotates together with the support member 47'. The detent member 186 has a pair of aligned slots 190 which open into the rectangular hole 188. The support member 47 has lugs 191 received in the slots 190. The lugs 191 in slots 190 help to key the detent member 186 to the support member 47'. The detent member 186 is molded integrally with an annular member or shaft 192 which is rotatable in an annular hole or opening 193 in the upstanding portion 48. The opening 187 is larger than the opening 193 and the frame portion 48 includes a shoulder 193'. The detent member 186 also has a pair of yieldable members 194. The yieldable members 194 have respective, integral, rounded projections 195. More specifically, the yieldable members 194 include springs 196 integrally joined at their opposite ends to a hub 197 and the portions of the springs 196 between opposite ends of the springs 196 are spaced from the hub 197 to allow the springs 196 to deflect as the projections 195 move out of one pair of recesses 198 onto arcuate portions 199 of the socket 187. The springs 196 will thereafter deflect outwardly when the projections 195 are aligned with another pair of recesses 198. The detent mechanism 185 releasably holds the support member 47′ in either the position shown in solid lines in FIG. 1 or in the position shown by phantom lines 47 PL. The support member 47′ supports a hub 201 which is the same as the hub 47*m* but is removably connected to the support member 47′ in a different manner. The hub 201 is connectable to the support member 47′ in one of two positions, namely, either with socket 202 or with socket 203. The sockets 202 and 203 are identical and can alternately cooperate with a bar 204 on hub 201. The hub 201 can be connected to the support member 47′ by inserting the bar 204 through the slot 205 and rotating the hub 201 in the direction of arrow 206. The bar rides up the cam surfaces 207 until the bar 204 seats in notches 208. Although a bayonet-type lock is used, other forms of connectors can be used instead.

Figure 25:
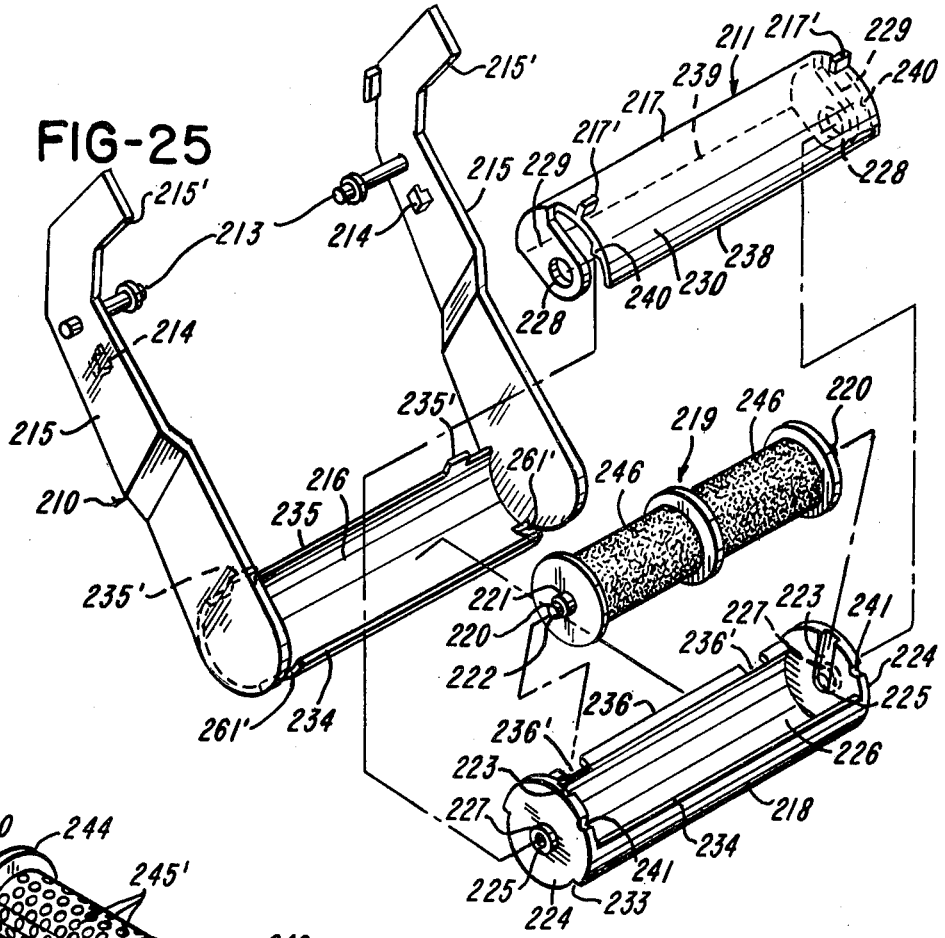
FIG. 25 is an exploded perspective view of an inking mechanism according to the invention.
Figure 26:
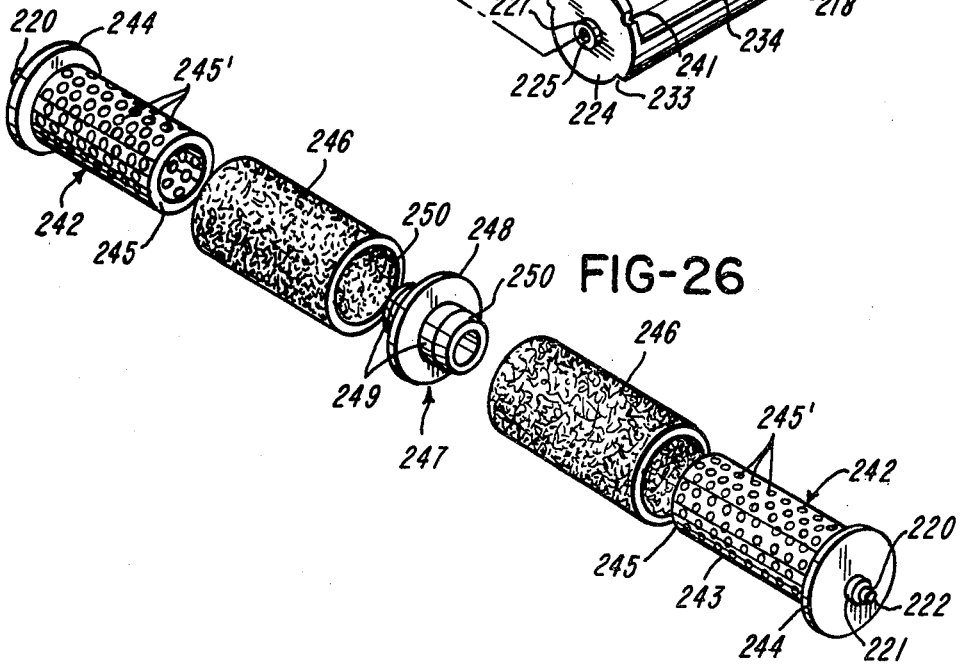
FIG. 26 is an exploded perspective view of a fountain roller also shown in FIG. 25 for example.

With reference to FIGS. 2 and 25, there is shown the inking mechanism 45 having a carrier generally indicated at 210 and a cartridge generally indicated at 211. A pair of spiral springs 212 (FIG. 2) received about pins 213 act against the support 74 and against projections 214 to urge the carrier 211 to the position shown in FIG. 5. The carrier 211 includes a pair of generally parallel, spaced arms 215 molded integrally with a transverse or lateral connecting portion 216 having a generally arcuate configuration.

The ink cartridge 211 includes a cover 211′ having a pair of rotary members specifically cover members 217 and 218 and an ink roller generally indicated at 219. The ink roller 219 has a pair of stud shafts or shaft portions 220. Each shaft portion 220 is stepped and has a large diameter portion 221 and a reduced diameter portion 222. To rotatably mount the ink roller 219 to the cover member 218, the shaft portions 220 are aligned with slots 223 in spaced, generally annular, end walls 224. The slots 223 are slightly tapered and have minimum depth adjacent holes 225. The shaft portions 220 deflect the end walls slightly as the shaft portions 220 slide along the slots 223 toward holes 225. When the shaft portions 220 are aligned with the through-holes 225 the ink roller 219 is held captive and is rotatably mounted by the cover member 218. The end walls 224 are joined by an arcuate transversely extending portion 226. Each end wall 224 has an outwardly extending annular projection 227. The holes 225 pass through respective projections 227. Each projection 227 is received in a respective annular hole 228 by flexing respective arm 229. The arms 229 are located at opposite ends of arcuate or curved portion 230 of the cover member 217. The cover member 217 can thus pivot between the position shown in FIG. 27 and the position shown in FIG. 28. An advantage of the cartridge 211 is that it can be coupled to the carrier 210 without smudging the user's fingers with ink. In addition, because the cover members 217 and 218 and end walls 224 enclose the ink roller 219, there is less tendency for the ink roller 219 to collect dust, or to dry out if such is the nature of the ink. FIG. 27 shows the position in which the cartridge 211 is first nested in the transverse member 216 of the carrier 210. The cartridge 211 is positioned between the arms 215. As shown in FIGS. 27 and 28, the cover member 218 has a small diameter portion 231 joined to a large diameter portion 232. The member 216 has an edge 234 that terminates at a step 233 (where portions 231 and 232 are joined) and a terminal end 235 that terminates at a flange 236 of member 218. In FIG. 27, the cartridge 211 is shown to be in its closed position in which cover members 217 and 218 and end walls 224 provide a closed chamber 237 for the ink roller 219. As shown, end edges 234 and 236 of the cover member 218 overlap end edges 238 and 239 of cover member 217. In the closed position, it is impossible for the user's hands to become smudged with ink from the ink roller 219. This would be true even if the cover member 217 were perforate or grid-like instead of solid as illustrated. To couple the cartridge 211 to the carrier 210, the cover member 217 is pivoted to the position shown in FIG. 28 to expose the ink roller 219 for inking the print head 44. As shown in FIG. 28, the transverse member 216 is captive in a gap 211″ between the cover members 217 and 218 so that the cartridge 211 is held securely to the transverse member 216. The gap 211″ is of course, filled by the transverse member 216. The underside of the cover member 217 has a pair of projections 240 cooperable with the recesses 241 on the outsides of the walls 224 in the position shown in FIG. 27, so as to hold the cover member 217 and 218 detented in the closed position with respect to each other. The member 216 also has recesses 241′, only one of which is shown, cooperable with the projections 240 to keep the cover member 217 releasably detented in the coupled position shown in FIG. 28. There is enough flexibility and resilience in the members 216, 217 and 218 to enable the projections 240 to be moved into and out of the pairs of recesses 241 and 241′. A pair of projections 217′ on the cover member 217 are manually engageable by the user to move the cover member 217 between the positions shown in FIGS. 27 and 28. There is a gap or slot 261′ in the transverse member 216 adjacent each arm 215 to allow clearance for the arms 229. The transverse member 216 also has a pair of projections 235′ received in notches or recesses 236′. The projections 235′ and recesses 236′ locate and help to key the cover member 218 with respect to the transverse member 216. The projections 235′ also function to prevent damage to the apparatus 40 in the event the apparatus is operated without a cartridge 211. Should this happen the projections 235′, which are aligned with lower side edges 251′ of plates 251, are cammed clockwise (FIG. 5) to the fully actuated position so that the entire carrier 210 is moved out of the path of the print head 44 as the print head 44 descends.

Should it happen that there is an obstruction such as the web of record member in the path of the inking mechanism 45 as it swings from its actuated position to its home or initial position shown in FIG. 5, projections 44′ on side plates 251 will contact projections 215′ on arms 215 as the print head 44 ascends to the initial or home position to cam the inking mechanism to the initial position shown in FIG. 5. In FIG. 5, the projections are illustrated by phantom lines 210 PL as being in the path of projections 44′.

When the cover member 217 has been returned to the position shown in FIG. 27 the cover is again in the closed position and the ink cartridge 211 can be removed from the apparatus 40 without the possibility that ink from the ink roller 219 will smudge the user's hands. When the ink cartridge 211 is spent of its ink supply, it can be replaced with a new ink cartridge.

The ink roller 219 is shown to have a pair of identical tubular hub members 242 and 243. Each hub member 242 and 243 has the stepped portion 220 integrally joined to a flange 244 which in turn is integrally joined to a perforate tubular sleeve 245. A sleeve or roll 246 of porous ink receptive material 246 is received on the respective roll mounting portion 245. The roll mounting portions 245 are connected by a one-piece connector generally indicated at 247. The connector 247 includes a solid flange or disc 248 and a tubular projection or connector portion 249 extending outwardly from each side of the flange 248. The outer marginal end 250 of each projection 249 is tapered for ease of assembly into the open end of the respective roll mounting portion 245. The central recess within each roll mounting portion is charged with ink. Each roll mounting portion 245 feeds ink to its respective sleeve 246 through holes 245'. The color of the ink in the one roll mounting portion and its respective sleeve 246 can differ from the color within the other roll mounting portion 245 and its respective sleeve 246. The flange 248 blocks ink flow from within one roll mounting portion 245 to the adjacent roll mounting portion which the flange 248 separates. For example, one color could be black and the other color could be red. In this way the print head 44 can print black characters or two lines on one record member R and the print head 44 can print red characters in two other lines on the adjacent record member R. Because of the stage printing, resulting record members R would have two lines of black characters and two lines of red characters. The solid flange or disc 248 also closes off any passage of ink between adjacent sleeves 246. The flanges 244 and 248 are bearing rolls that roll on edges 251' of side plates 251 and on edge 147' of wall 147 while sleeves 246 ink printing members 257.

With reference to FIG. 29, there is shown another view of the print head frame 146. The print head 44 also includes a pair of side walls or side plates 251 which straddle the wall 147. Each selector 252 extends through the side plates 251 and is selectively engageable with any one of an aligned series of drive wheels 253. Each series of drive wheels 253 has both internal and external teeth and is rotatably supported at its outer periphery at a concave mounting surface 254. Each mounting surface 254 is formed integrally with a respective mounting block 255 and each mounting block 255 is shown to have an integrally formed support or anvil 256. Printing members or bands 257 are trained about respective drive wheels 253 and a respective support 256. The platen 87 has two pairs of upstanding truncated V-shaped guides 258 which are spaced to provide a tapered opening 259. The side plates 251 have respective guided portions 260 which are guided into the respective openings 259 between adjacent guides 258. Thus, the print head 44 is guided into its final printing position near the very end of the printing stroke.

The wall 147 of the print head 44 is disposed generally medially between the side plates 251 for balancing the forces applied by the printing bands 256 on opposite sides of the wall 147. The print head frame 146 is of one-piece molded plastics construction.

With reference to FIGS. 1 and 2, the cover 43 is shown to be pivotally mounted at the upper part of the upstanding portion 48 and is movable from the normal operating position shown in FIG. 5 in which moving components of the apparatus are enclosed during use to the position shown in FIG. 1 in which the operating components are accessible. The support 74 has a horizontally extending groove 261. A one-piece hinge member generally indicated at 262 has a projection or ridge 263 coextensive with and received in the groove 261. The projection 263 is formed on a portion 264 of the hinge member 262 which is clamped between the upstanding portion 48 and the support 74. No additional means of holding the portion 264 to the upstanding portion 48 is required. The hinge member 262 also includes a hinge 265 which connects the portion 264 and a bifurcated cover holding portion 266 which straddles a portion of panel 43' of the cover 43.

With reference to FIGS. 2, 3 and 5, there is shown a printed circuit board 267 extending horizontally and spaced upwardly from the panel 94 and disposed below the horizontal portion 49. The printed circuit board 267 carries the controls for the printer. The circuit board 267 mounts the control panel 50 which has a series of switches 50' which extend through an opening in the horizontal portion 49. The circuit board 267 carries a sensor 268 which is responsive to a magnet 269 secured to the cam 57. The sensor 268 senses the position of the cam 57 so that the apparatus 40 is always brought to an initial position in which the print head 40 is in its upper or home position and the feed fingers 110 are farthest to the right as viewed in FIG. 1. The components on the circuit board 267 control the electric motor 52.

With reference to FIG. 31, there is shown a printing apparatus generally indicated at 40' which is identical to the apparatus 40 except that the electric motor 52, gear 54, sensor 268, the magnet 269 and the circuit board 267 have been omitted. The cam 57 has a handle or knob 270 which can be used to turn the cam 57 manually to cycle the apparatus 40'.

To ensure good lateral registration of the web of record members R, the platen 87 is stepped by a guide edge 87*a*. As best shown in FIG. 10 the axis 120*a* of the shaft portions 120 and hence of the sleeve 122 is canted slightly with respect to the perpendicular P to the edge 87*a*. Thus, as the sleeve 122 is rotated by the advancing web, one edge of the web is driven against the edge 87*a* because of this slight canting. The upper surface of the platen 87 is a guide surface for the web.

As shown in FIGS. 1 and 30, the side plate 47*s* has a pair of circumferentially spaced identical ridges 47*v*. FIG. 30 shows that the ridge 47*v* has a concave circumferentially extending surface 47*w*. A ring or disc 47*x* is shown to have a continuous, circular, convex inner edge or opening 47*y* which interfits with the surface 47*w*. The radius of the opening 47*y* is less than the radius of the side plate 47*s* to either ridge 47*v*. The sides of the side plate 47*s* and the disc 47*x* are shown to be co-planar. The disc 47*x* serves as an extension of the side plate 47*s* and is useful where the rolls R' or R" have larger diameters than shown in the drawings. The side plate 47*s* and the disc 47*x* are relatively thin and at least the side of the side plate 47*s* and the side of the disc 47*x* adjacent the roll R' or R" should preferably be co-planar to avoid problems during unwinding or paying out of the web. The disc 47*x* can be easily flexed and snapped onto or removed from the disc 47*s*. Although the disc 47*n* is not illustrated as having the feature of an extended side plate as when side plate 47*s* and disc 47*x* are used, the outer circumference of the side plate 47*n* can be like the outer circumference of the side plate 47*s* with its ridges 47*v* and a disc such as the disc 47*x* can be used therewith so that side plate 47*n* can also be extended.

Figure 32:
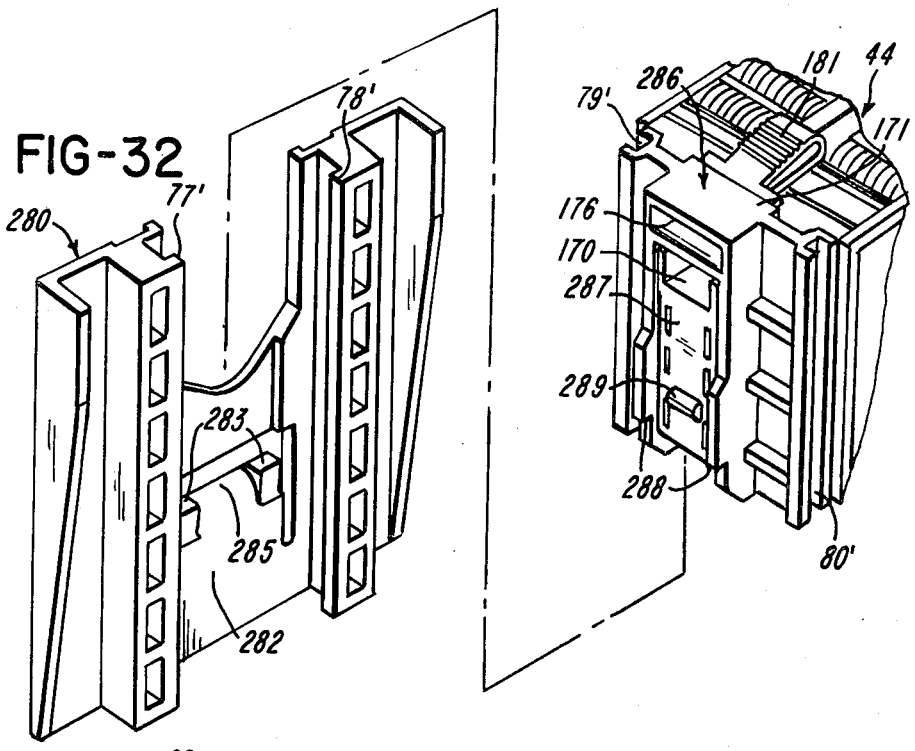
FIG. 32 is a partly exploded and rotated view of the print head support and a fragmentary portion of the print head with an impression control arrangement in accordance with another embodiment of the invention.
Figure 33:
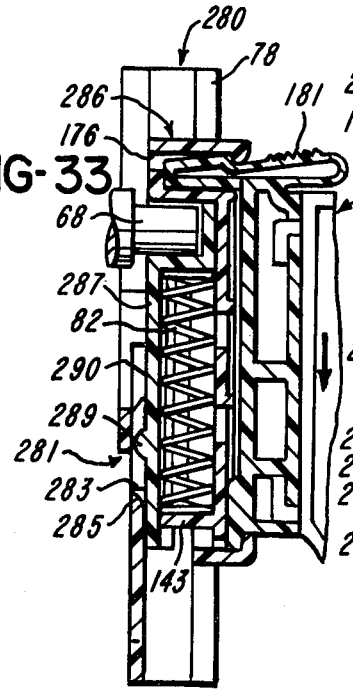
FIG. 33 is a partly sectional side elevational view of the components shown in FIG. 32 moving as a unit.
Figure 34:
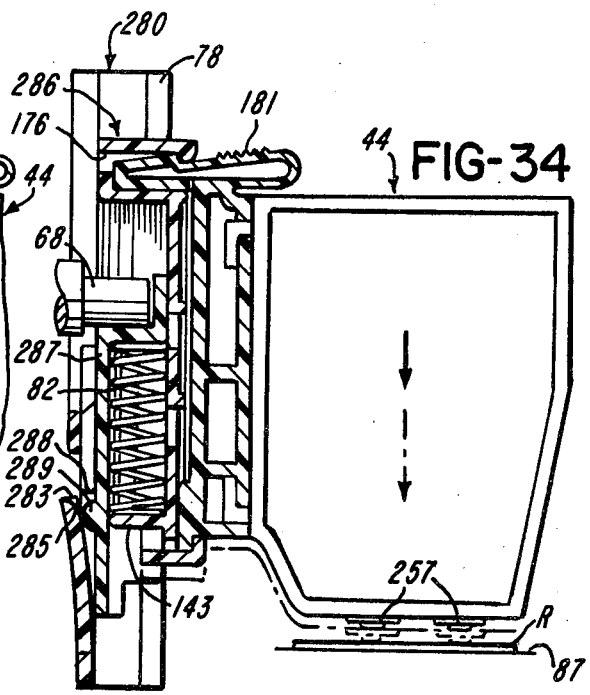
FIG. 34 is a view similar to FIG. 33 but showing the print head in profile in both solid line and phantom line positions and also showing other components in different positions.

With reference to the embodiment of FIGS. 32 through 34, there is shown the print head support generally indicated at 280 which is similar to the print head support 74. The structure for mounting the inking mechanism 45 is identical to that shown and described in connection with the support 74 but is not illustrated for the sake of clarity and to avoid redundancy. There is shown an impression control device or mechanism generally indicated at 281 which includes a leaf spring 282 molded integrally with the support 280. The leaf spring 282 has a pair of laterally spaced stop faces 283 and a cam surface or face 285 disposed between the stop faces 283. The print head 44 is secured to the support 280 by a coupling device 286. Coupling member 287 differs from the coupling member 71 in that the coupling member 287 has a pair of laterally spaced shoulders or abutment faces 288 aligned with the stop faces 283. The coupling member 287 has a cam member 289 molded integrally with rear wall 290. The cam member 289 is aligned with the cam face 285. The shoulders 288 are equally displaced from the cam member 289 so that the shoulders 288 on coupling member 171 contact both stop faces 283 before the cam member 289 contacts cam face 285. As the drive member 68 moves from its uppermost position toward its lowermost position, the coupling device 286 including its coupling members 171 and 287 and the print head 44 move as a unit toward the platen 87. Upon continued movement, the shoulders 288 contact the stop faces 283. As movement of drive member 68 continues the loading of spring 82 increases because the movement of the coupling member 171 is stopped but the movement of the coupling member 287 continues. The loading of the spring 82 continues until the cam member 289 acts on the cam surface 285 and deflects the leaf spring 282 by a predetermined amount. When this happens, the stop faces 283 move out of contact with shoulders 288 as shown in the solid line position of FIG. 34 and the spring 82 acting on land 143 drives the print head 44 into printing cooperation with two of the record members R on the platen 87. The imprint caused by the print head 44 on the record members R is thus not dependent on the speed at which the drive member 68 moves as it drives the print head 44 toward the platen 87. The printing members 257 are shown in FIG. 34 in both solid line and phantom line positions. When the drive member 68 starts moving upwardly again, the shoulders 288 move to positions upward of the stop faces 283, and the cam member 289 moves out of contact with the cam surface 285. As the cam member 289 moves upwardly the amount of force exerted by the cam member on the cam surface 285 decreases and the leaf spring 282 returns to the position shown in FIG. 33. As the drive member 68 continues to move upwardly the print head 44 and the coupling device 286 move as a unit until the drive member 68 stops at its home or initial position.

Figure 35:
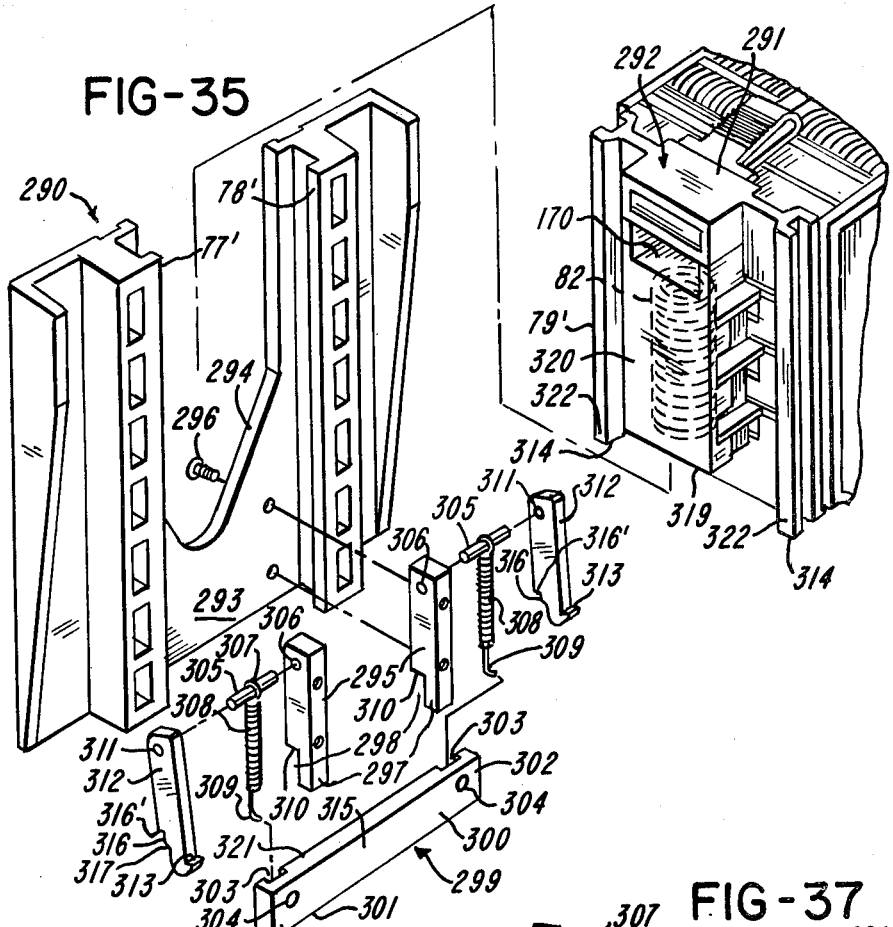
FIG. 35 is a partly exploded and rotated view of the print head and a fragmentary portion of the print head with an alternative impression control arrangement.
Figure 36:
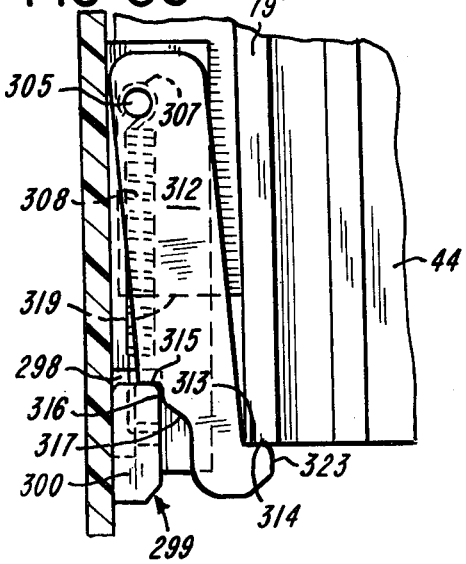
FIG. 36 is a partly sectional side elevational view of the components shown in FIG. 35.
Figure 37:
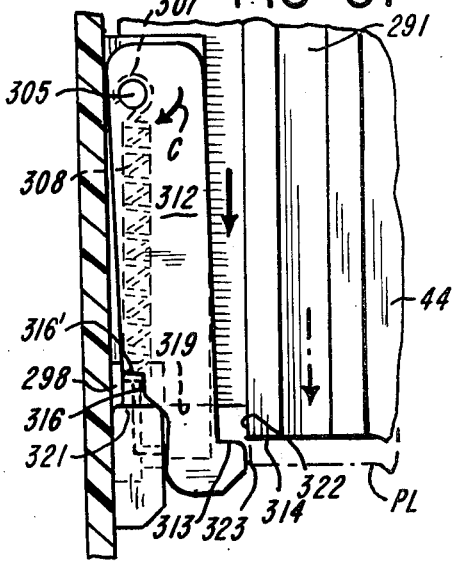
FIG. 37 is a view similar to FIG. 36 but showing certain components in a moved position from the position shown in FIG. 36.

With reference to the embodiment of FIGS. 35 through 37, there is shown a support generally indicated at 290. The support 290 is very similar to the support 74 but again the structure associated with the inking mechanism has been omitted. The support 290 has spaced guides 77' and 78' for slidably mounting coupling member 291 of coupling device 292. The coupling device 292 is the same as the coupling device 286 except as described below. The support 290 has a wall 293 with a cutout 294. A pair of spaced brackets 295 are suitably secured as by screws 296, only one of which is shown, to the wall 293. The brackets 295 have guide members 297 spaced from the wall 293. The space between the wall 293 and each guide member 297 provides a slot 298 in which an interposer generally indicated at 299 in the form of a bar 300 is slidably guided by guide members 297. The bar 300 has channels 303 and holes 304 opening into the channels 303. The brackets 295 mount aligned pins 305 press-fitted into respective holes 306. One end portion 307 of a spring 308 is hooked to each pin 305, and the other end portion 309 of each spring 308 extends into the respective channel 303 and is hooked into the hole 304. The springs 308 urge the interposer 299 upwardly (FIGS. 35 through 37) but the interposer 299 does not bottom on surfaces 310. Each pin 305 extends into holes 311 in latch or latch member 312. There is sufficient clearance between the pins 305 and their respective holes 311 to enable the latch members 312 to pivot. Each latch member 312 has a stop or stop face 313. FIG. 36 shows stop face 313 of one latch member 312 to be in the path of abutment face 314 of track member 79'. The front surface 315 of bar 300 provides a stop or stop face for each of the shoulders or abutment faces 316 of latch member 312. Each latch member 312 also has a cam surface 317 which provides a lead into abutment face 316. The stop faces 313 are in the path of the abutment faces 314 when abutment faces 316 are against stop face 315. In this position of the interposer 299, the latch members 312 cannot pivot clockwise from the position shown in FIG. 36. Thus, as the drive member 68 received in slot 318 in coupling member 291 is driven downwardly, the shoulder 314 is moved into abutment with stop face 313. As the drive member 68 continues to move downwardly the spring 82 continues to be loaded further. When end surface or abutment face 319 of coupling member 320 starts to contact upper surface 321 of bar 300, the print head 44 is still spaced slightly from the record members R on which the print head 44 is to print. When the stop face 315 of the bar 300 of the interposer 299 moves to a position out of the path of the abutment face 316 as shown in FIG. 37 the abutment faces 314 act on the stop faces 313 to pivot the latch members 312 clockwise in the direction of arrow C. This pivoting occurs because the faces 314 act on the latch members 312 at shoulders 313 that are offset from the axis of pins 305. In the position shown in FIG. 37 the coupling member 291 is being released (FIG. 37 illustrating the release) and the coupling member 291 and the print head 44 are driven downwardly by the spring 82 from the solid line position to the phantom line position PL. The print head 44 thus is driven into cooperation with the platen 87. When the drive member 68 thereafter moves upwardly on its return stroke, surfaces 322 move upwardly to a position clear of terminal ends 323 of the latch members 312. Upon continued upward movement of the drive member 68, the interposer 299 is pulled upwardly by springs 308 and cams latch members 312 counterclockwise from the position in FIG. 37 to the position shown in FIG. 36. Now the stop faces 313 are again in alignment with the abutment faces 314. The upward movement of the coupling member 320 continues even after the interposer 299 contact shoulders 316' of latch members 312. When the drive member 68 completes its return stroke, the abutment faces 314 are spaced above the stop faces 313 with which they are aligned.

There are certain differences between the supports 74, 280 and 290, and there are also certain differences between the coupling members 70, 168, 286 and 292. These differences have all been described. In addition the pairs of coupling members 168 and 171, 287 and 171, and 320 and 291 are all coupled in the same way as the coupling members 71 and 81 as described above in considerable detail and as shown in considerable detail in the appended drawings.

Almost the entire printing apparatus is composed of molded plastics material. There are relatively few metal parts namely plate 51, motor 52 and its shaft 53, bellcrank 64, platen 87, springs 47e, 82, 212 and 308, possibly panel 94, feed fingers 110, clutch 121, printed circuit board 267 (in part), sensor 268, magnet 269, pins 305, and various screws. Ink-receptive material 246 can be molded or extruded and printing bands 259 are also molded. With the above construction, multiple functions are built into relatively few molded plastics parts. Thus, the total number of parts is kept to a bare minimum resulting in a low-cost printing apparatus which is easy to manufacture even in large quantities. The apparatus 40, 40' is lightweight and portable.

The electrically operated printing apparatus 40 of any of the disclosed embodiments weighs about thirteen pounds, but the apparatus 40' of the embodiment of FIG. 31 weighs about seven pounds.

Other embodiments and modifications of the invention will suggest themselves to those skilled in the art, and all such of these as come within the spirit of this invention are included within its scope as best defined by the appended claims.

I claim:

1. Printing apparatus, comprising: a print head having printing members, means for movably mounting the print head between initial and printing positions, an inking mechanism including a pivotally mounted carrier, an ink roller rotatably mounted by the carrier, and spring means for urging the carrier to an initial position in which the ink roller is in the path of movement of the print head, the print head being effective to move the carrier against the urging of the spring means as the print head moves from its initial position to the printing position to move the ink roller in one direction into inking relationship with the printing members, and means for returning the carrier to its initial position and to move the print head in the opposite direction in the event the spring means fails to return the carrier to its initial position during return of the print head to its initial position.

2. Printing apparatus, comprising: a print head having printing members, means for movably mounting the print head between initial and printing positions, an inking mechanism including a pivotally mounted carrier, an ink roller rotatably mounted by the carrier, spring means for urging the carrier to an initial position in which the ink roller is in the path of movement of the print head, the print head having means for camming the carrier against the urging of the spring means from its initial position to an actuated position out of the path of the print head as the print head moves from its initial position to its printing position, and means effective in the event the spring means fails to return the carrier to its initial position for camming the carrier to its initial position during return of the print head to its initial position.

3. Printing apparatus, comprising: a print head having printing members, a platen, the print head being movable in a path between an initial position spaced from the platen and a printing position in printing cooperation with the platen, an inking mechanism including a carrier having a pair of connected arms, the one end portions of the arms being pivotally mounted for movement between an initial position in the path of the print head and an actuated position out of the path of the print head, spring means for urging the carrier to its initial position, means on the print head for camming the carrier against the urging of the spring means from its initial position to its actuated position as the print head moves from its initial position to its printing position, and the arms having projections which are in the path of the print head as the print head moves from the printing position to its initial position so that the print head drives the carrier to its initial position upon failure of the spring means to return the carrier to its initial position.

4. Printing apparatus, comprising: a print head having printing members, a platen, the print head being movable in a path between an initial position spaced from the platen and a printing position in printing cooperation with the platen, an inking mechanism including a carrier having a pair of connected arms, the one end portions of the arms being pivotally mounted for movement between an initial position in the path of the print head and an actuated position out of the path of the print head, spring means for urging the carrier to its initial position, means on the print head for camming the carrier against the urging of the spring means from its initial position to its actuated position as the print head moves from its initial position to its printing position, the arms having projections which are in the path of the print head as the print head moves from the printing position to its initial position so that the print head drives the carrier to its initial position upon failure of the spring means to return the carrier to its initial position, wherein the projections are formed integrally with the arms.

5. Printing apparatus, comprising: a print head having printing members, a platen, the print head being movable in a path between an initial position spaced from the platen and a printing position in printing cooperation with the platen, an inking mechanism including a carrier having a pair of connected arms, the one end portions of the arms being pivotally mounted for movement between an initial position in the path of the print head and an actuated position out of the path of the print head, spring means for urging the carrier to its initial position, means on the print head for camming the carrier against the urging of the spring means from its initial position to its printing position as the print head moves from its initial position to its printing position, the arms having projections which are in the path of the print head as the print head moves from the printing position to its initial position so that the print head drives the carrier to its initial position upon failure of the spring means to return the carrier to its initial position, wherein the spring means comprises a separate spring acting on each arm, wherein the carrier includes a transversely extending cartridge holder connecting the arms, wherein the carrier is composed of one-piece molded plastics material, and a cartridge containing an ink roller and being replaceably mounted to the cartridge holder.

* * * * *